US007181822B2

(12) United States Patent
Ondrovic et al.

(10) Patent No.: US 7,181,822 B2
(45) Date of Patent: Feb. 27, 2007

(54) METHOD AND APPARATUS FOR CONTROLLING STRIP SHAPE IN HOT ROLLING MILLS

(75) Inventors: Jay Jon Ondrovic, Brownsburg, IN (US); Richard Britanik, Sarver, PA (US); Tino Domanti, Coal Point (AU); Glen Wallace, Whitebridge (AU)

(73) Assignee: Nucor Corporation, Charlotte, NC (US)

( * ) Notice: Subject to any disclaimer, the term of this patent is extended or adjusted under 35 U.S.C. 154(b) by 0 days.

(21) Appl. No.: 11/039,013

(22) Filed: Jan. 20, 2005

(65) Prior Publication Data

US 2006/0156778 A1 Jul. 20, 2006

(51) Int. Cl.
*B21B 1/46* (2006.01)

(52) U.S. Cl. ..... 29/527.7; 72/9.1; 164/476

(58) Field of Classification Search ..... 72/8.9, 72/9.1, 11.7, 201; 29/527.7; 164/414, 476
See application file for complete search history.

(56) References Cited

U.S. PATENT DOCUMENTS

| | | | | |
|---|---|---|---|---|
| 3,334,508 | A * | 8/1967 | Martin | 72/364 |
| 4,272,976 | A * | 6/1981 | Pizzedaz | 72/45 |
| 5,212,975 | A | 5/1993 | Ginzburg | |
| 5,799,523 | A | 9/1998 | Seidel et al. | |
| 6,014,881 | A * | 1/2000 | Imanari | 72/201 |
| 6,044,895 | A * | 4/2000 | Kuttner et al. | 164/155.4 |
| 6,092,586 | A * | 7/2000 | Schonbeck | 164/476 |
| 6,490,903 | B2 | 12/2002 | Ravenet et al. | |
| 2001/0007200 | A1 | 7/2001 | Ravenet et al. | |

FOREIGN PATENT DOCUMENTS

| | | |
|---|---|---|
| EP | 140877 | 5/1985 |
| JP | 08-090033 | 4/1996 |
| JP | 10-323706 | 12/1998 |
| JP | 11-129010 | 5/1999 |
| JP | 11-319917 | 11/1999 |
| JP | 2000167613 | 6/2000 |
| JP | 2001030002 | 2/2001 |

* cited by examiner

*Primary Examiner*—Lowell A. Larson
(74) *Attorney, Agent, or Firm*—Hahn Loeser & Parks LLP; Arland T. Stein

(57) ABSTRACT

A hot rolling mill and method for operating the hot rolling mill where the shape of the strip is controlled by localized cooling devices positioned at intervals along work rolls in at least three lateral zones, a central and two edge zones, and capable of separately cooling each zone to control the shape of the work rolls in that zone and inhibit the formation of shape defects occurring in the strip being rolled. Five zones may be provided across the work surface of the work rolls so that two intermediate zones can control for quarter buckles. The hot rolling mill has particular application in continuously casting thin strip. The method can be made automatic by sensing downstream of the hot mill the shape of the strip in each zone.

19 Claims, 8 Drawing Sheets

METHOD AND APPARATUS FOR CONTROLLING STRIP SHAPE IN HOT ROLLING MILLS

BACKGROUND AND SUMMARY OF THE INVENTION

This invention relates to hot rolling mills and particularly to those used continuous casting of thin steel strip a twin roll caster.

In a twin roll caster, molten metal is introduced between a pair of counter-rotated horizontal casting rolls which are cooled so that metal shells solidify on the moving roll surfaces, and are brought together at the nip between them to produce a solidified strip product delivered downwardly from the nip between the casting rolls. The term "nip" is used herein to refer to the general region at which the casting rolls are closest together. The molten metal may be poured from a ladle through a metal delivery system comprised of a tundish and a core nozzle located above the nip to form a casting pool of molten metal supported on the casting surfaces of the rolls above the nip and extending along the length of the nip. This casting pool is usually confined between refractory side plates or dams held in sliding engagement with the end surfaces of the rolls so as to dam the two ends of the casting pool against outflow.

When casting steel strip in a twin roll caster, the strip leaves the nip at very high temperatures on the order of 1400° C. or higher. If exposed to normal atmosphere, it would suffer very rapid scaling due to oxidation at such high temperatures. Therefore, a sealed enclosure is provided beneath the casting rolls to receive the hot strip and through which the strip passes away from the strip caster, the enclosure containing an atmosphere which inhibits oxidation of the strip. The oxidation inhibiting atmosphere may be created by injecting a non-oxidizing gas, for example, an inert gas such as argon or nitrogen, or combustion exhaust gases which may be reducing gases. Alternatively, the enclosure may be sealed against ingress of oxygen containing atmosphere during operation of the strip caster. The oxygen content of the atmosphere within the enclosure is then reduced during an initial phase of casting by allowing oxidation of the strip to extract oxygen from the sealed enclosure as disclosed in U.S. Pat. Nos. 5,762,126 and 5,960,855. A thin strip is generally hot rolled in a hot rolling mill after the strip emerges from the caster to shape the thin strip.

It was generally understood in the past that to produce rolled product with acceptable shape in the hot rolling mill in the caster, as well as in other applications of the hot rolling mill, the mill roll gap profile should as near as possible to the cross-sectional profile of the incoming strip. Significant deviations between the incoming product profile and roll gap profile produces a localized shape defect in the outgoing rolled strip at the location across the strip width where the deviations occurs. If the roll gap thickness is less than the incoming strip thickness in that region relative to adjacent regions across the strip width, a buckle or loose defect occurs in the strip shape in that area producing a shape defect. This shape defect is characterized by lower than average tension stress. If the roll gap thickness is greater than the incoming strip thickness in that region relative to adjacent regions across the strip width, a tight or ridge strip shape defect will be produced in that area of the strip. The tight or ridge shape is characterized by higher than average tension stress.

The roll gap profile is determined principally by the ground profile of the work rolls. However, under operating load, the roll gap profile is also determined by the material characteristics of the incoming strip, the ground profiles of the mill rolls, the stack deflection of the mill rolls, mill housing stretch, and thermal effects due to heat generated in the roll gap by rolling. In the past, mill actuators have been provided that are capable of dynamically influencing the roll gap profile by some compensation for these parameters to make the roll gap profile better approach conformance to the incoming strip profile. For example, work roll bending jacks have been provided to affect symmetrical changes in the roll gap profile central region of the work rolls relative to regions adjacent the edges. The roll bending is capable of correcting symmetrical shape defects that are common to the central region and both edges of the strip. Also, force cylinders can affect asymmetrical changes in the roll gap profile on one side relative to the other side. The roll force cylinders are capable of skewing or tilting the roll gap profile to correct for shape defects in the strip that occur asymmetrically at either side of the strip, with one side being tighter and the other side being looser than average tension stress across the strip. Another device available is the use of spray nozzles at the edges of the strip, particularly thicker strip, to adjust for crown drop at the edges of the strip by cooling in such way that the edges drop caused by the transverse flow behavior of the material during rolling can be reduced or minimized. See U.S. Pat. No. 5,799,523.

In the course of hot mill rolling, in a cast strip plant and elsewhere, local shape defects can still occur in the strip that are not correctable by roll bending, roll force cylinder skewing or edge spraying of the strip. Typical examples of such shape defects are quarter buckle, local pocket buckles, local tight ridges or edge wave defects.

The present invention provides a method and apparatus for localized modification of the roll gap profile to correct these types of shape defects By controlling the localized cooling of the work surface of the work roll in zones across the work roll, both the upper and lower work roll profiles can be controlled by thermal expansion or contraction of the work rolls sufficient to produce thin steel strip without pronounced shape defects and without causing localized buckling, ridges and edge wave in the strip. We have found that it is possible to change the outlying areas of the strip profile in a zone or zones across the work roll, both high areas and low areas, relative to adjacent regions, and that that can be done without causing localized buckling, ridges and edge wave in the thin strip. This is done by changing the profile of the work surface of the work roll by localized control of the cooling of a zone or zones of the work roll where the shape defect is observed relative to adjacent regions Specifically, the control of localized cooling can be accomplished by increasing the relative volume or velocity, or decreasing of temperature, of coolant sprayed through nozzles onto the work roll surfaces in the zone or zones of an observed strip shape buckle or loose area, causing the work roll diameter of either or both of the work rolls in that area to contract, increasing the roll gap profile, and effectively tightening the strip shape in that region to alleviate pronounced defects in the strip without causing localized buckling, ridges and edge wave in the strip. Conversely, by decreasing the relative volume or velocity, or increasing the temperature, of the coolant sprayed by the nozzles onto the work surfaces of the work rolls in the zone or zones where shape ridge or tight area is observed in the strip, the work roll diameter in that area expands, decreasing the roll gap profile, and effectively loosening the strip shape in that area to alleviate pronounced defects in the strip without causing localized buckling, ridges and edge wave in the strip. Alternatively or in combination, the control of localized cooling can be accomplished by internally controlling cooling the work surface of the work roll in zones across the work roll by localized control of temperature or volume water circulated through the work rolls adjacent the work surfaces.

A method is provided for controlling strip shape in a hot rolling mill comprising:

a. assembling a hot mill having work rolls with work surfaces forming a gap between them through which hot strip is rolled, said work rolls having roll work surfaces relating to a desired strip profile to be rolled;
b. localized controlling of cooling of the work surface of the work rolls in at least three lateral zones, a central and two edge zones;
c. rolling strip between the work rolls; and
d. varying the localized cooling in each zone along the work rolls so as to locally control the shape and inhibit the formation of local shape defects in the strip rolled by the hot rolling mill.

Moreover, five zones, a central zone, two edge zones and two intermediate or quarter zones, can be provided, so that quarter buckles can be inhibited which is a particularly difficult problem in hot rolling. The number of zones provided may be increased to the number of localized cooling devices that the geometry adjacent the work rolls permit to be positioned in a particular embodiment. There can be more than one row of localized cooling devices, e.g., two or more rows of nozzles, positioned adjacent the work surface so that adjacent zones may not be necessarily serviced by localized cooling devices in the same row. The localized cooling devices can be positioned to overlap so that the regions of the work roll surface are covered at least across the portion where strip engages the work rolls, and typically beyond where strip engages the work rolls, to provide for effective localized controlling of cooling of the work roll surface being controlled. Conversely, a zone could be serviced by two or more localized cooling devices not all of which are necessarily capable of individual control. There needs to be, however, localized controlling of cooling of the work surface of the work rolls in each zone to provide effective control of the strip shape. In other words, the zones of controlled localized cooling should be such as to cover the surface of the work roll at least in the area where the strip encounters the work roll, but may extend substantially beyond the edge of the strip, and may include the entire work roll, to provide effective control of the strip shape.

On the other hand, if sprays from nozzles are used as the localized cooling devices, the sprays from nozzles onto the work surface should not impinge on each other because in so going the sprays can interfere with each other and reduce effective control in shaping of the work roll within a zone, and in turn reduce effective control the shape defects observed in the strip of the strip Whether the control of localized cooling is accomplished by one or more sprays or internal circulation of coolant within each zone, the coolant is typically water, although other coolants may be utilized as desired. The localized controlling of cooling of the work surface of the work rolls in each zone thus can be accomplished by varying the volume, velocity and temperature of coolant impacting on the work surface of the work rolls in each zone.

The method of controlling strip shape in a hot rolling mill may comprise the additional steps of:

e. sensing downstream of the hot rolling mill the shape in the strip in each zone; and
f. automatically varying the cooling by the localized cooling device(s) in each zone through a control system controlled by the strip shape sensed in the strip in each zone downstream of the hot rolling mill.

The strip shape in each zone may be measured by a tension roll, laser measuring distance or any other suitable device to dynamically measure strip shape.

Additionally or alternatively, a method of producing thin cast strip with a controlled strip shape by continuous casting is provided comprising the steps of:

a. assembling a thin strip caster having a pair of casting rolls having a nip there between;
b. assembling a metal delivery system capable of forming a casting pool between the cast rolls above the nip with side dams adjacent the ends of the nip to confine said casting pool;
c. assembling adjacent the thin strip caster a hot rolling mill having work rolls with work surfaces forming a gap between them through which hot strip from the caster is rolled, said work rolls having work roll surfaces relating to a desired strip shape to be roll;
d. assembling localized cooling devices positioned at intervals along the work surfaces of the work rolls of the hot rolling mill in at least three lateral zones, a central and two edge zones, and capable of localized cooling the work surface of at least one of the work rolls;
e. assembling a control system capable of individually regulating the cooling by the localized cooling devices within zones on the work surface of at least one work roll of the hot rolling mill;
f. introducing molten steel between the pair of casting rolls to form a casting pool supported on casting surfaces of the casting rolls confined by side dams;
g. counter-rotating the casting rolls to form solidified metal shells on the surfaces of the casting rolls and cast thin steel strip through the nip between the casting rolls from said solidified shells; and
h rolling the thin cast strip between the work rolls of the hot rolling mill and varying the cooling within each zone so as to control the shape of the work rolls and inhibit the formation of shape defects encountered in the thin cast strip in the zones.

Again, importantly, five zones, a central zone, two edge zones and two intermediate or quarter zones, can be provided so that quarter buckles can be inhibited. As with the hot rolling mill in other embodiments, the number of zones provided may be increased to the number of localized cooling devices that the geometry adjacent the work rolls permit to be positioned in a particular embodiment. There can be more than one row of localized cooling devices, e.g., two or more rows of nozzles, positioned adjacent the work surface so that adjacent zones may not necessarily be serviced by localized cooling devices, e.g., nozzles, in the same row. The localized cooling devices can be positioned to overlap so that the regions of the work roll surface are covered at least across the portion where strip engages the work rolls, and typically beyond where strip engages the work rolls, to provide for effective localized controlling of cooling of the work surface control. Conversely, a zone could be serviced by two or more localized cooling devices not all of which are necessarily capable of individual control. There need to be, however, localized controlling of cooling of the work surface of the work rolls in each zone to provide effective control of the strip shape. In other words, the zones of controlled localized cooling should be such as to cover the surface of the work roll at least in the area where the strip encounters the work roll, but may extend substantially beyond the edge of the strip, and may include the entire work roll, to provide effective control of the strip shape.

On the other hand, if sprays from nozzles are used as the localized cooling devices, the sprays from nozzles on the work surface should not impinge on each other, because in so going the sprays can interfere with each other and reduce effective control in shaping of the work roll within a zone, and in turn reduce effective control the shaping of defects observed in the strip of the strip. Again, whether the control of localized cooling is accomplished by one or more sprays or internal circulation of coolant within each zone, the coolant is typically water, although other coolants may be utilized as desired. The localized controlling of cooling of the work surface of the work rolls in each zone thus can be accomplished by varying the flow volume, velocity and temperature of coolant impacting on the work surface of the work rolls in each zone.

There, the method of producing thin cast strip with a controlled strip shape by continuous casting may comprise the additional steps of:

i. sensing downstream of the hot rolling mill the shape on the strip in each zone; and j. automatically varying the cooling by at least one of the localized cooling devices in each zone through a control system controlled by the strip shape sensed in the strip in each zone downstream of the hot rolling mill.

A hot rolling mill is also provided comprising:

a. work rolls with work surfaces forming a gap between them through which hot strip is rolled, said work rolls having work roll surfaces relating to a desired strip profile to be rolled;

b. cooling devices positioned at intervals across the work rolls in at least three lateral zones, a central and two edge zones, and capable of individually regulating the cooling of the work rolls in each zone; and c. a control system capable of individually regulating the cooling devices within each zone so as to control the shape profile of the work surfaces of the work rolls in each zone, and in turn inhibit the formation of shape defects in strip rolled by the hot rolling mill in each zone.

In the hot rolling mill, there may be in particular five zones, a central zone, two edge zones and two intermediate or quarter zones, along the working surface of the work roll to control for quarter buckles in the strip which is a particular problem. As with the method of operating the hot rolling mill, the number of zones that can be provided in the hot rolling mill can be expanded to the number of localized cooling devices that can be provide with the geometry of a particular embodiment. There can be two or more rows of localized cooling devices positioned adjacent the work surface so that devices in a row may not necessarily serviced adjacent zones. The localized cooling devices can be thus easily positioned to overlap so that the regions of the work roll surface are covered at least across the portion where strip engages the work rolls, and typically beyond where strip engages the work rolls, to provide for effective localized controlling of cooling of the work surface. Conversely, a zone could be serviced by two or more localized cooling devices not all of which are capable of individual control. In any case, the localized cooling in each zone may overlap between zones at the work surface of the work rolls to provide effective control of the shape of the work roll surface and the strip shape. In another words, the zones of controlled localized cooling should be such as to cover the surface of the work roll at least in the area where the strip encounters the work roll, but may extend substantially beyond the edge of the strip, and may include the entire work roll, to provide effective control of the strip shape. On the other hand, if sprays from nozzles are used as the localized cooling devices, the sprays from nozzles onto the work roll surface should not impinge on each other to provide effective control in shaping of the work roll surface within a zone, and in turn control the shape defects observed in the strip in each zone Whether the control of localized cooling is accomplished by sprays or circulation in the hot rolling mill, the coolant is typically water, with other coolants utilized as desired. The localized controlling of cooling of the work surface of the work rolls in each zone thus can be accomplished by varying the flow volume, velocity and temperature of coolant impacting on the work surface of the work rolls in each zone.

A thin cast strip plant may also be provided for producing strip with a controlled strip shape by continuous casting comprising:

a. a thin strip caster having a pair of casting rolls having a nip there between;

b. a metal delivery system capable of forming a casting pool between the cast rolls above the nip with side dams adjacent the ends of the nip to confine said casting pool;

c. a hot rolling mill adjacent the thin strip caster having work rolls with work surfaces forming a gap between them through which hot strip can be rolled, said work rolls having work roll surfaces relating to a desired strip profile to be rolled;

d. a plurality of localized cooling devices positioned at intervals along the work rolls of the hot rolling mill capable of localized control of cooling of the work surface of at least one of the work rolls in at least three lateral zones, a central and two edge zones, with the cooling of the work surface within each zone being capable of being individually controlled;

e. a drive capable of counter-rotating the casting rolls to form solidified metal shells on the surfaces of the casting rolls and cast thin steel strip through the nip between the casting rolls from said solidified shells; and f. a control system capable of individually regulating localized control of cooling of the work surface by cooling device(s) in each zone of the work roll so as to control the shape of the work surface and inhibit the formation of shape defects in the thin cast strip in each zone.

There may be in particular five zones, a central zone, two edge zones and two intermediate or quarter zones, to control for quarter buckles in the strip. Again, the number of zones that can be provided in the hot rolling mill can be expanded to the number of localized cooling devices that can be provide with the geometry of a particular embodiment. There can be more than one row of localized cooling devices, e.g., two or more rows of nozzles, positioned adjacent the work surface so that adjacent zones may not necessarily be serviced by localized cooling devices in the same row. The localized cooling devices can be thus easily positioned to overlap so that the regions of the work roll surface are covered at least across the portion where strip engages the work rolls, and typically beyond where strip engages the work rolls, to provide for effective localized controlling of cooling of the work surface control. Conversely, a zone could be serviced by two or more localized cooling devices not all of which are capable of individual control. In any case, the localized cooling by the localized cooling devices in each zone may overlap between zones at the work surface of the work rolls to provide effective control of the shape of the work roll surface and the strip shape, In another words, the zones of controlled localized cooling should be such as to cover the surface of the work roll at least in the area where the strip encounters the work roll, but may extend substantially beyond the edge of the strip, and may include the entire work roll, to provide effective control of the strip shape. On the other hand, if sprays from nozzles are used as the localized cooling devices, the sprays from nozzles onto the work roll surface should not impinge on each other to provide effective control in shaping of the work roll surface within a zone, and in turn effective control the shaping of defects observed in the strip in each zone Whether the control of localized cooling is accomplished by sprays or internal coolant circulation in the work rolls of the hot rolling mill, the coolant is typically water, with other coolants utilized as desired. The localized controlling of cooling of the work surface of the work rolls in each zone thus can be accomplished by varying the volume, velocity and temperature of coolant impacting on the work surface of the work rolls in each zone.

In each embodiment of the method, mill and plant, the localized controlling of cooling of the work surface of the work roll needs to have the thermal effect to locally expand and contract the diameter the work roll to make a substantial change in the roll gap, and affect the desired local roll shape control in each zone. This localized controlling of cooling of the work surface of the work roll is in addition to the coolant that may be sprayed on the work roll at the same time to cool the work roll. In any case, the effectiveness on the strip shape control depends upon the temperature differential between the work roll surface and the coolant, as well as the coolant volume and velocity sprayed onto or circulated within the particular zone of the work surface of the work roll. The coolant practice may be modified to minimize the fixed coolant volume while maintaining work roll surface temperatures within an acceptable range, e.g. below 120° C. (250° F.), while the strip is typically about 1200° C. The devices controlling localized cooling used for shape control may be turned completely off at the start of a casting campaign, or set at some intermediate level so that regulating the localized cooling devices can both expand and contract the work roll diameter in a zone. As local areas with loose shape are observed, the localized cooling devices can be regulated adjacent the upper and lower work rolls in the zone corresponding to where a shape defect is observed to contract or expand the work roll diameter, increase or decrease the relative roll gap and tighten or loosen the strip shape coming out of the hot rolling mill.

If spray nozzles used as the localized cooling devices, with controllable nozzles at about every two inches across the strip width, the ratio of coolant volume for shape defect correction to uncontrolled spray volume for cooling of the work rolls is in the range from about 1 to 1 up to 3 to 1. In another words, the volume of the coolant from the controllable nozzles to effect localized cooling in each zone may be about 100% to 300% of the volume from the nozzles that are constantly spraying the work surface to cool the work roll. The actual total gallon per minute flow depends on the thickness of the strip being made, upon whether both the upper and lower work are being locally cooled, upon the setting of the main upper and/or lower work roll coolant supply valves, the temperature of the coolant, and the sizes of the individual spray nozzles (which may be the same or different for the spray nozzles used to generally cool the work rolls).

The hot rolling mill may automatically control strip shape by providing sensors in a sensor roll positioned downstream of the mill to sense localized shape in the strip along the width of the strip, and a control system capable of controlling the flow of coolant sprayed on the work rolls in the individual zones through controllable localized cooling devices. By this arrangement, the hot rolling mill can automatically adjust for shape defects sensed in the strip by regulating the localized cooling in each zone in the individual zones along the work surface of the work roll, and in turn controlling the shape of the surface of the work rolls of the mill and the shape of the thin steel strip.

BRIEF DESCRIPTION OF THE DRAWINGS

The operation of an illustrative twin roll casting plant in accordance with the present invention is described with reference to the accompanying drawings, in which.

DESCRIPTION OF THE PREFERRED EMBODIMENTS

Figure 1:
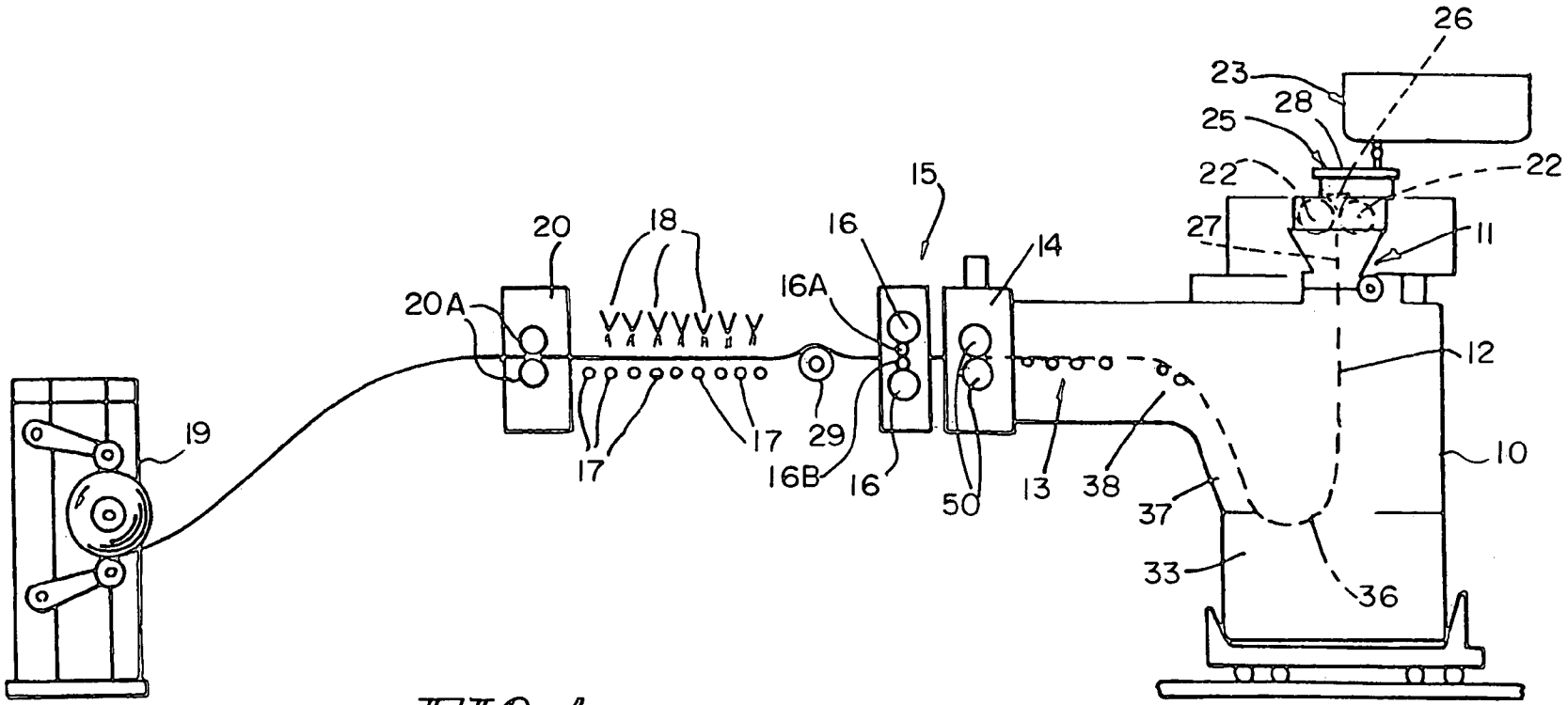
FIG. 1 is a schematic illustrating a thin strip casting plant having a hot rolling mill for controlling the shape of cast strip.

The illustrated casting and rolling installation comprises a twin-roll caster denoted generally by 11 which produces thin cast steel strip 12 which passes into a transient path across a guide table 13 to a pinch roll stand 14. After exiting the pinch roll stand 14, thin cast strip 12 passes into and through hot rolling mill 15 comprised of back up rolls 16 and upper and lower work rolls 16A and 16B, where the thickness of the strip reduced. The strip 12, upon exiting the rolling mill 16, passes onto a run out table 17 where it may be forced cooled by water jets 18, and then through pinch roll stand 20 comprising a pair of pinch rolls 20A and to a coiler 19.

Twin-roll caster 11 comprises a main machine frame 21 which supports a pair of laterally positioned casting rolls 22 having casting surfaces 22A and forming a nip 27 between them. Molten metal is supplied during a casting campaign from a ladle (not shown) to a tundish 23, through a refractory shroud 24 to a removable tundish 25 (also called distributor vessel or transition piece), and then through a metal delivery nozzle 26 (also called a core nozzle) between the casting rolls 22 above the nip 27. Removable tundish 25 is fitted with a lid 28. Molten steel is introduced into removable tundish 25 from tundish 23 via an outlet of shroud 24. The tundish 23 is fitted with a stopper rod and a slide gate valve (not shown) to selectively open and close the outlet 24 and effectively control the flow of molten metal from the tundish 23 to the caster. The molten metal flows from removable tundish 25 through an outlet and optionally to and through the core nozzle 26.

Molten metal thus delivered to the casting rolls 22 forms a casting pool 30 above nip 27 supported by casting roll surfaces 22A. This casting pool is confined at the ends of the rolls by a pair of side dams or plates 28, which are applied to the ends of the rolls by a pair of thrusters (not shown) comprising hydraulic cylinder units connected to the side dams. The upper surface of the casting pool 30 (generally referred to as the "meniscus" level) may rise above the lower end of the delivery nozzle 26 so that the lower end of the deliver nozzle 26 is immersed within the casting pool.

Casting rolls 22 are internally water cooled by coolant supply (not shown) and driven in counter rotational direction by drives (not shown) so that shells solidify on the moving casting roll surfaces and are brought together at the nip 27 to produce the thin cast strip 12, which is delivered downwardly from the nip between the casting rolls.

Below the twin roll caster 11, the cast steel strip 12 passes within a sealed enclosure 10 to the guide table 13, which guides the strip to a pinch roll, stand 14 through which it exits sealed enclosure 10. The seal of the enclosure 10 may not be complete, but is appropriate to allow control of the atmosphere within the enclosure and access of oxygen to the cast strip within the enclosure as hereinafter described. After exiting the sealed enclosure 10, the strip may pass through further sealed enclosures (not shown ) after the pinch roll stand 14.

Enclosure 10 is formed by a number of separate wall sections which fit together at various seal connections to form a continuous enclosure wall. These sections comprise a first wall section 41 at the twin roll caster to enclose the casting rolls 22, and a wall enclosure 42 extending downwardly beneath first wall section 41 to form an opening that is in sealing engagement with the upper edges of a scrap box receptacle 40. A seal 43 between the scrap box receptacle 40 and the enclosure wall 42 may be formed by a knife and sand seal around the opening in enclosure wall 42, which can be established and broken by vertical movement of the scrap box receptacle 40 relative to enclosure wall 42. More particularly, the upper edge of the scrap box receptacle 40 may be formed with an upwardly facing channel which is filled with sand and which receives a knife flange depending downwardly around the opening in enclosure wall 42. Seal 43 is formed by raising the scrap box receptacle 40 to cause the knife flange to penetrate the sand in the channel to establish the seal. This seal 43 can be broken by lowering the scrap box receptacle 40 from its operative position, preparatory to movement away from the caster to a scrap discharge position (not shown).

Scrap box receptacle 40 is mounted on a carriage 45 fitted with wheels 46 which run on rails 47, whereby the scrap box receptacle can be moved to the scrap discharge position. Carriage 45 is fitted with a set of powered screw jacks 48 operable to lift the scrap box receptacle 40 from a lowered position, where it is spaced from the enclosure wall 42, to a raised position where the knife flange penetrates the sand to form seal 43 between the two.

Sealed enclosure 10 further may have a third wall section disposed 61 about the guide table and connected to the frame of pinch roll stand 14, which includes a pair of pinch rolls 50. The third wall section disposed 61 of enclosure 10 is sealed by sliding seals 63.

Most of the enclosure wall sections 41, 42 and 61, maybe lined with fire brick. Also, scrap box receptacle 40 may be lined either with fire brick or with a castable refractory lining.

In this way, the complete enclosure 10 is sealed prior to a casting operation, thereby limiting access of oxygen to thin cast strip 12, as it passes from the casting rolls 22 to the pinch roll stand 14. Initially the strip can take up all of the oxygen from enclosure 10 space by forming heavy scale on an initial section of the strip. However, the sealing enclosure 10 limits ingress of oxygen into the enclosure from the surrounding atmosphere to below the amount of oxygen that could be taken up by the strip. Thus, after an initial start-up period, the oxygen content in the enclosure 10 will remain depleted so limiting the availability of oxygen for oxidation of the strip 12. In this way, the formation of scale is controlled without the need to continuously feed a reducing or non-oxidizing gas into the enclosure.

Of course, a reducing or non-oxidizing gas may be fed through the enclosure walls. However, in order to avoid the heavy scaling during the start-up period, the enclosure 10 can be purged immediately prior to the commencement of casting so as to reduce the initial oxygen level within enclosure 10, thereby reducing the time period for the oxygen level to stabilize in the enclosure as a result of the interaction of the oxygen in oxidizing the strip passing through it. Thus, illustratively, the enclosure 10 may conveniently be purged with, for example, nitrogen gas. It has been found that reduction of the initial oxygen content to levels of between 5% and 10% will limit the scaling of the strip at the exit from the enclosure 10 to about 10 microns to 17 microns even during the initial start-up phase.

Figure 2:
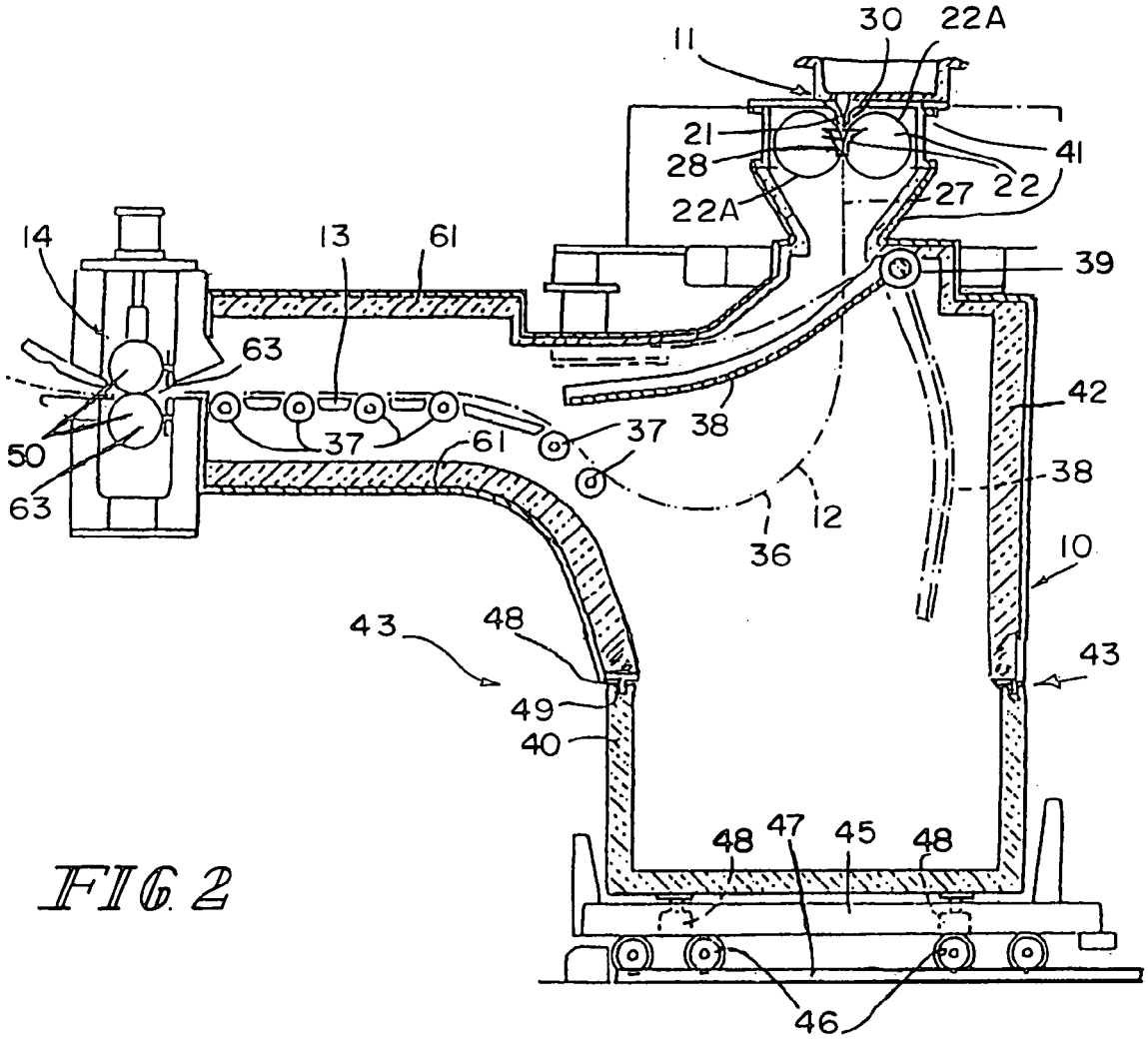
FIG. 2 is an enlarged cut-away side view of the caster of the thin strip casting plant of FIG. 1.
Figure 3:
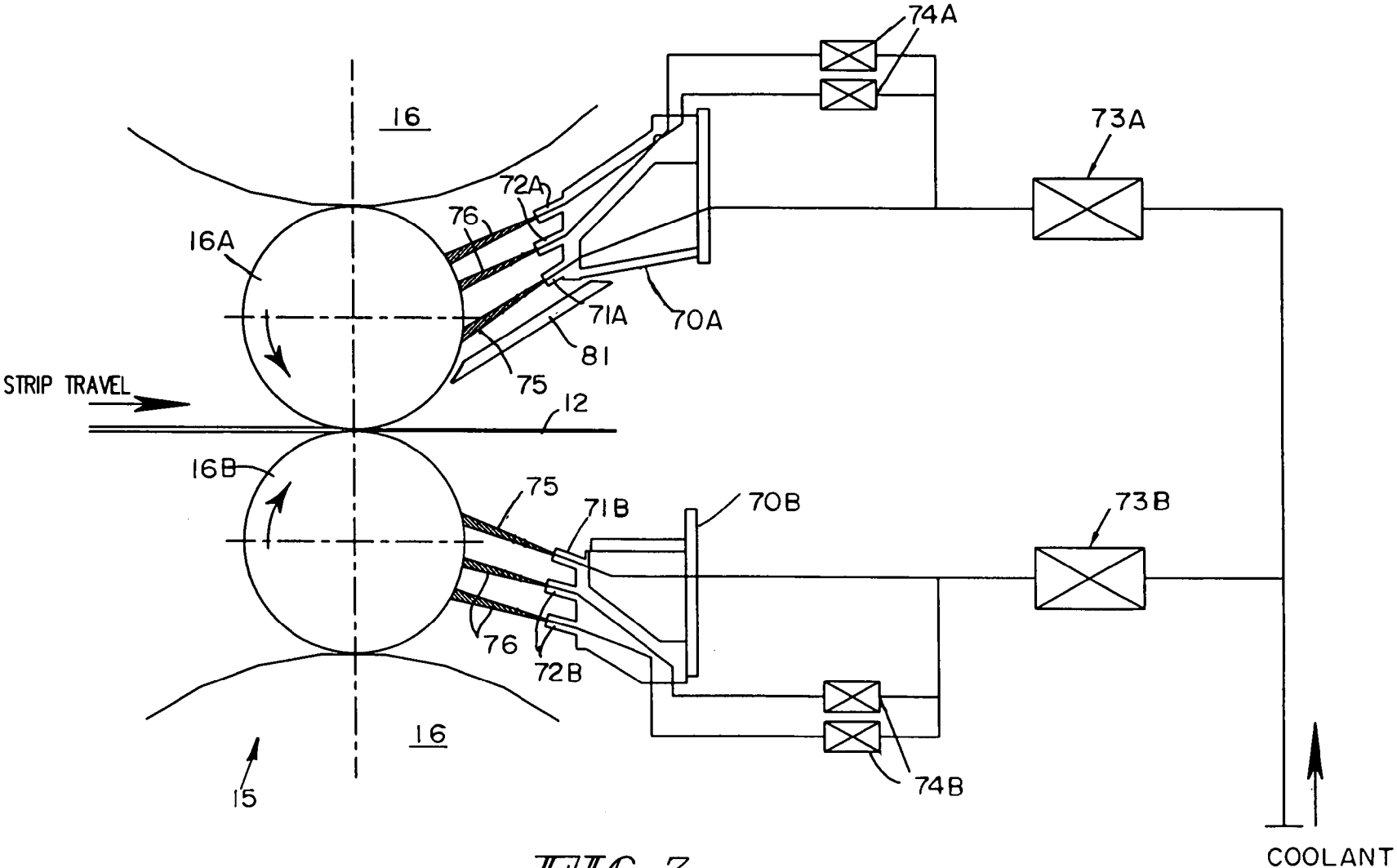
FIG. 3 is a fragmentary side view of the hot rolling mill of the thin strip casting plant of FIG. 1 showing the arrangement of the localized cooling devices.
Figure 4:
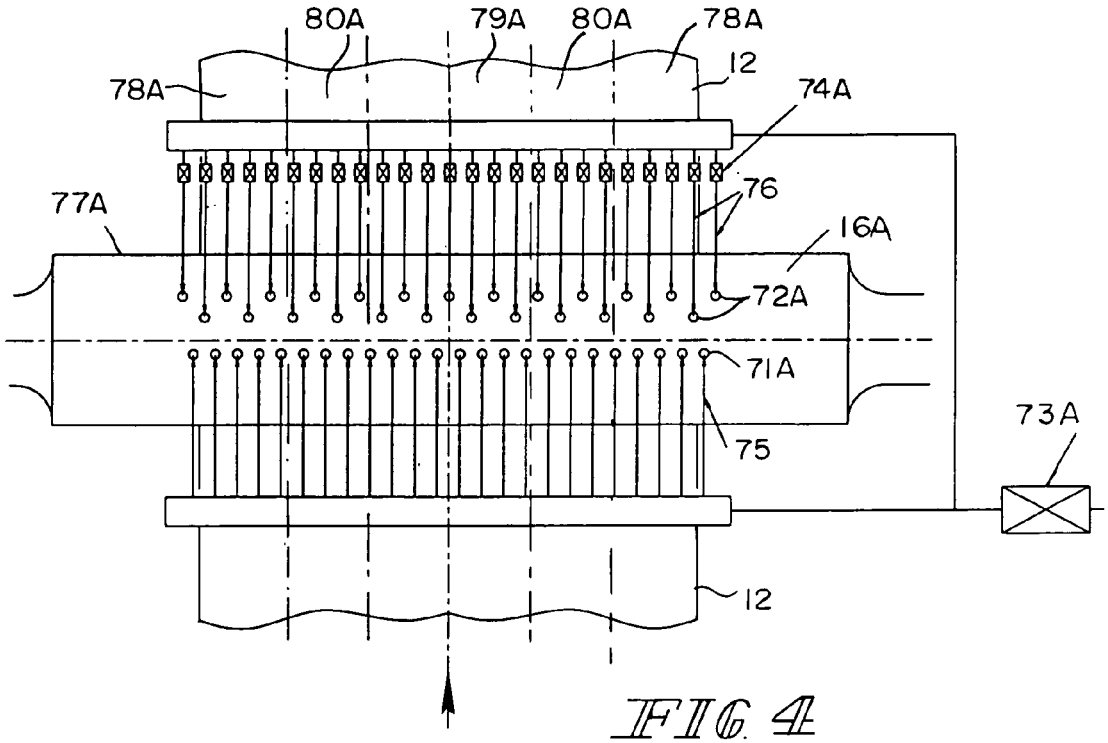
FIG. 4 is a fragmentary view showing the cooling pattern from the localized cooling devices of the hot rolling mill in the thin strip casting plant of FIG. 1.
Figure 5:
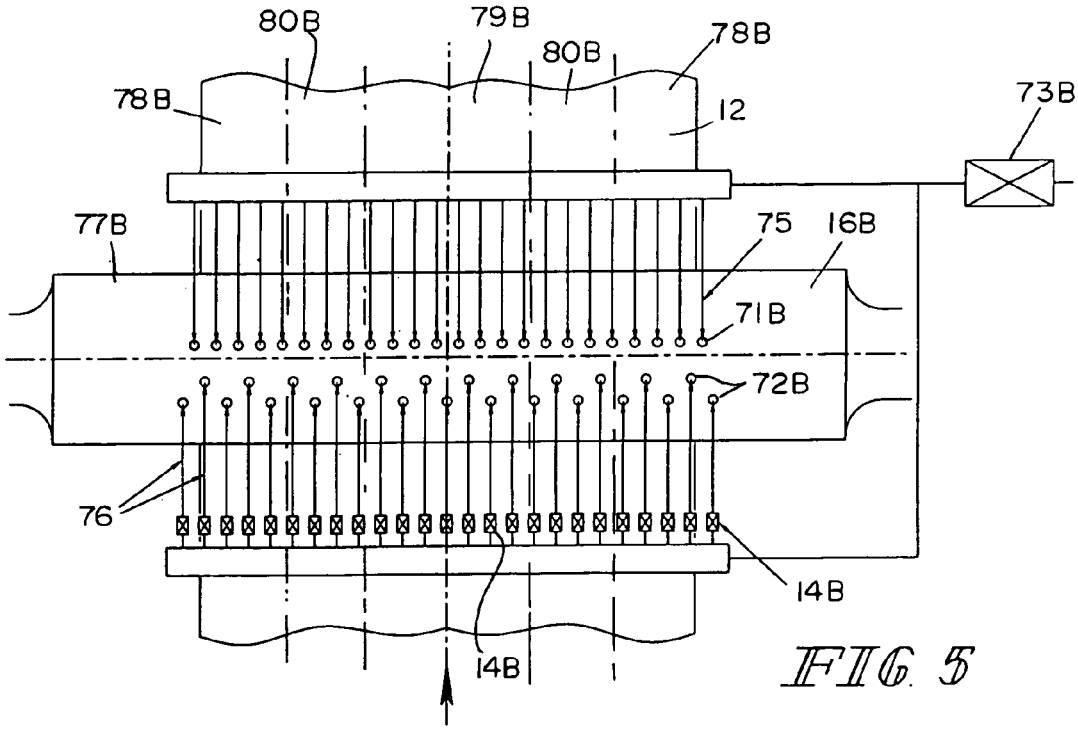
FIG. 5 is a fragmentary view showing the cooling pattern from the localized cooling devices of the hot rolling mill in the thin strip casting plant of FIG. 1.

At the start of a casting campaign a short length of imperfect strip is produced as the casting condition stabilize. After continuous casting is established, the casting rolls 22 are moved apart slightly and then brought together again to cause this lead end of the strip to break away in the manner described in Australian Patent 646,981 and U.S. Pat. No. 5,287,912, to form a clean head end of the following thin cast strip 12. The imperfect material drops into scrap box receptacle 40 located beneath caster 11, and at this time swinging apron 34, which normally hangs downwardly from a pivot 39 to one side of the caster as shown in FIG. 2, is swung across the caster outlet to guide the clean end of thin cast strip 12 onto the guide table 13 where the strip is fed to the pinch roll stand 14. Apron 38 is then retracted back to its hanging position as shown in FIG. 2 to allow the strip 12 to hang in a loop 36 beneath the caster as shown in FIGS. 1 and 2 before the strip passes onto the guide table 13. The guide table 13 comprises a series of strip support rolls 37 to support the strip before it passes to the pinch roll stand 14. The rolls 37 are disposed in an array extending from the pinch roll stand 14 backwardly beneath the caster and curve downwardly to smoothly receive and guide the strip from the loop 36.

The twin-roll caster may be of a kind which is illustrated and described in detail in U.S. Pat. Nos. 5,184,668 and 5,277,243, or U.S. Pat. No. 5,488,988. Reference may be made to these patents for construction details, which are no part of the present invention.

Pinch roll stand 14 comprises a pair of pinch rolls 50 reactive to tension applied by the hot rolling mill 15. Accordingly, the strip is able to hang in the loop 36 as it passes from the casting rolls 22 to the guide table 13 and into the pinch roll stand 14. The pinch rolls 50 thus provides a tension barrier between the freely hanging loop and tension on the strip downstream part of the processing line. The pinch rolls 50 also stabilize the position of the strip on the feed table 38, feeding the strip into hot rolling mill 15. However, it has been found in practice that there is a strong tendency for the strip to wonder laterally on the guide table 13 to such an extent as to produce distortion in the shape of the loop 36. The consequence is generation of waviness and cracks in the strip margins, and in extreme cases complete disruption of the strip by massive transverse cracking.

In order to control wavering of the strip, pinch rolls 50 are convex in shape to grip the strip as much as possible across its width, and a pair of pneumatic or hydraulic cylinder units (not shown) are disposed one at each end of pinch rolls 50. The cylinder units 32 are independently operable so as to vary the pressure applied to the two gripping locations, whereby to cause a differential in velocity imposed on the strip 12 at those locations and consequently to steer the strip. In this way, the pinch rolls 50 can be operated to steer it according the differential in the strip gripping intensity at the gripping locations spaced laterally of the strip.

From the pinch roll stand 14, the thin cast strip 12 is delivered to the hot roll mill 15 comprised of upper work roll 16A and lower roll 16B. Adjacent the upper work roll 16A is header 70A supplying coolant to three rows of nozzles 71A and 72A. The row of nozzles 71A closest to the strip contains 24 nozzles capable of delivering, for example, 470 gpm of coolant at 100 psi from the header 70A. Nozzles 71A are not regulated during the casting campaign but cool the upper work roll 16A throughout the casting campaign. The remaining two rows of nozzles 72A have a row of 12 nozzles capable of delivering, for example, 235 gpm of coolant at 100 psi and a further row of 13 nozzles interleaved with the previous row capable of delivering, for example, 400 gpm at 100 psi from the header 70A. The nozzles 72A in the two rows are spaced so that the sprays from the nozzles do not interfere with each other so as to reduce the cooling efficiency of the sprays. Control of the coolant sprays 75 from nozzles 71A and the coolant sprays 76 from nozzles 72A may be manually controlled by upper header valve 73A or by a flow meter 73A that is preset by an operator to a desire flow rate. In addition, at least some, and typically most, if not all, of sprays 76 from nozzles 72A are individually controlled by individual control valves 74A located in each of at least three lateral zones across the work surface 77A of upper work roll 16A, two edge zones 78A and a central zone 79A. Additionally, intermediate or quarter zones 80A may be provided to control for quarter buckles in particular; or any number of zones may be provided limited only by the geometry of the embodiment and the number nozzles 72A regulated by individual control valves 74A. It is understood that the individual control valves 74A can control more than one nozzle 72A in a given zone depending on the particular embodiment of the hot rolling mill. However, typically an individual control valve 74A is provided for each nozzle 72A to impart more flexibility and effectiveness in operation of the hot mill to control the shape of the work roll 16A and in turn the shape of the cast strip. The nozzles 72A may be positioned typically about 2 inches apart. In any case, the sprays from the nozzles 72A are set so that the spray spread do substantially overlap between zones across the work surface 77A of the work roll 16A. In this way, the controllable nozzles 72A are able to response to and effectively control shape defects anywhere across the entire strip 12. A swiper bar 81 is also provided to drain away the sprayed coolant from sprays 75 and 76 of nozzles 71A and 72A after the coolant impacts onto the work surface 77A, so that the coolant is inhibited from contacting the strip 12 where it could cause defects from localized cooling.

Similarly, adjacent the lower work roll 16B is header 70B supplies coolant to three rows of nozzles 71B and 72B. The row of nozzles 71B closest to the strip contains 24 nozzles capable of delivering, for example, 470 gpm of coolant at 100 psi from the header 70B. Nozzles 71B are not regulated during the casting campaign, but provide coolant to cool the lower work roll 16B throughout the casting campaign. The remaining two rows of nozzles 72B have a row of 12 nozzles capable of delivering, for example, 235 gpm of coolant at 100 psi and a further row of 13 nozzles interleaved with the previous row capable of delivering, for example, 400 gpm of coolant at 100 psi from the header 70B. Here again, the nozzles 72B in the two rows are spaced so that the sprays from the nozzles do not interfere with each other so as to reduce the cooling efficiency of the sprays. Manual control of the coolant sprays 75 from nozzles 71B and the coolant sprays 76 from nozzles 72B are manually controlled by lower header valve 73B. In addition, at least some, and typically most if not all of sprays 76 from nozzles 72B are individually controlled by individual control valves 74B located in each of at least three lateral zones across the work surface 77B of upper work roll 16B, two edge zones 78B and a central zone 79B. Additionally, intermediate or quarter zones 80B may be provided, or any number of zones may of zones can be provided limited only by the number nozzles 72B regulated by individual control valves 74B. It is understood that the individual control valves 74B can control more than one nozzle 72B in a given zone depending on the particular embodiment of the hot rolling mill. However, typically an individual control valve 74B is provided for each nozzle 72B to impart more flexibility and effectiveness in operation of the hot rolling mill to control strip shape. The nozzles 72B may be positioned typically about 2 inches apart. In any case, nozzles 72B are set with spray spreads from the nozzle do substantially overlap between zones across the work surface 77B of the work roll 16B. In this way, the controllable nozzles 72B are able to response to and control the shape of the work surface of the lower work roll 16B anywhere and in turn for shape defects anywhere in the strip 12.

During the casting campaign, the work rolls 16A and 16B are maintained at a temperature at an acceptable range (e.g., below 250° C.). by the coolant sprays 75 and 76, while the strip 12 passing through the hot rolling mill is typically at about 1200° C. Most of the cooling of the work rolls is provided by sprays 75 from nozzles 71A and 71B nearest the strip, so that the coolant from nozzles 72A and 72B is available primarily to control the shape of the strip. The normal control action for the controllable nozzles 72A and 72B is to increase or decrease coolant spray flow (volume and/or velocity) to the work surfaces 77A and 77B of the work rolls 16A and 16B in areas of the strip exhibiting loose or tight shape. Since some of nozzles 72A and 72B in the outer two rows may be preset to a partially closed position to allow flow control when automatic flow control is employed, the normal operating mode may be to leave all individual control valves 74A on nozzles 72A on the upper header 70A adjacent in about the 40 to 60% open position. Alternatively, where manual control is employed, the normal operating mode may be to leave all individual control valves 74A on nozzles 72A on the upper header 70A adjacent in close position to start. In any case, the header 70B to the lower work roll 16B, an individual supply controlled by control valves 74B, is implemented for each of the twenty five nozzles 72B in the middle and lower bank (furthest from the strip 12) of nozzles 72B.

Figure 6:
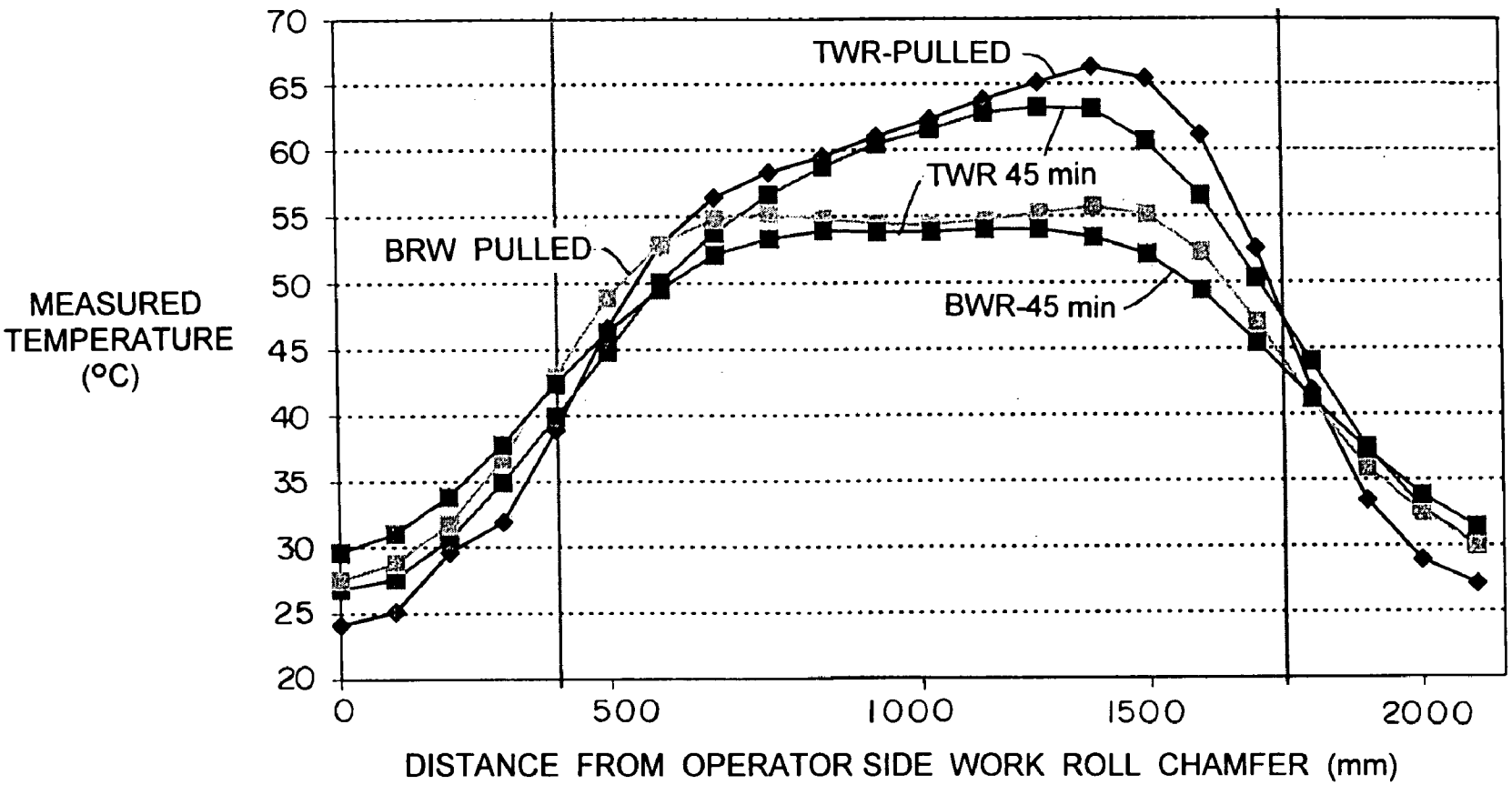
FIG. 6 is a graph showing the temperature as a function of distance across the top and bottom work rolls of a hot rolling mill in a thin strip casting plant without controlling for shape of the strip in accordance with the present invention.

As shown in FIG. 6, observations during rolling in one casting sequence showed a continuous quarter buckle by rolling thin cast strip 12, with little or no possibility of removal. After completion of the run, roll temperature measurements were taken for both the upper and lower work rolls 16A and 16B. ("TWR" and "BWR," respectively). FIG. 6 shows the temperature measurements taken shortly after the end of rolling and approximately 45 minutes after the completion of rolling with the work rolls 16A and 16B. An approximate indication of the strip edge is also provided in FIG. 6. The figure shows a relatively normal temperature profile on the lower work roll 16B (BWR); however a significant temperature rise was observed on the drive side of the upper work roll 16A (TWR). This was confirmed in the two sets of measurements. In an attempt to avoid the quarter buckle in a subsequent casting sequence, a different set of work rolls 16A and 16B were installed in the hot rolling mill 15. However, a severe drive side quarter buckle was observed on the drive side of the strip, likely from the asymmetry in the temperature profile shown in FIG. 6.

Figure 8:
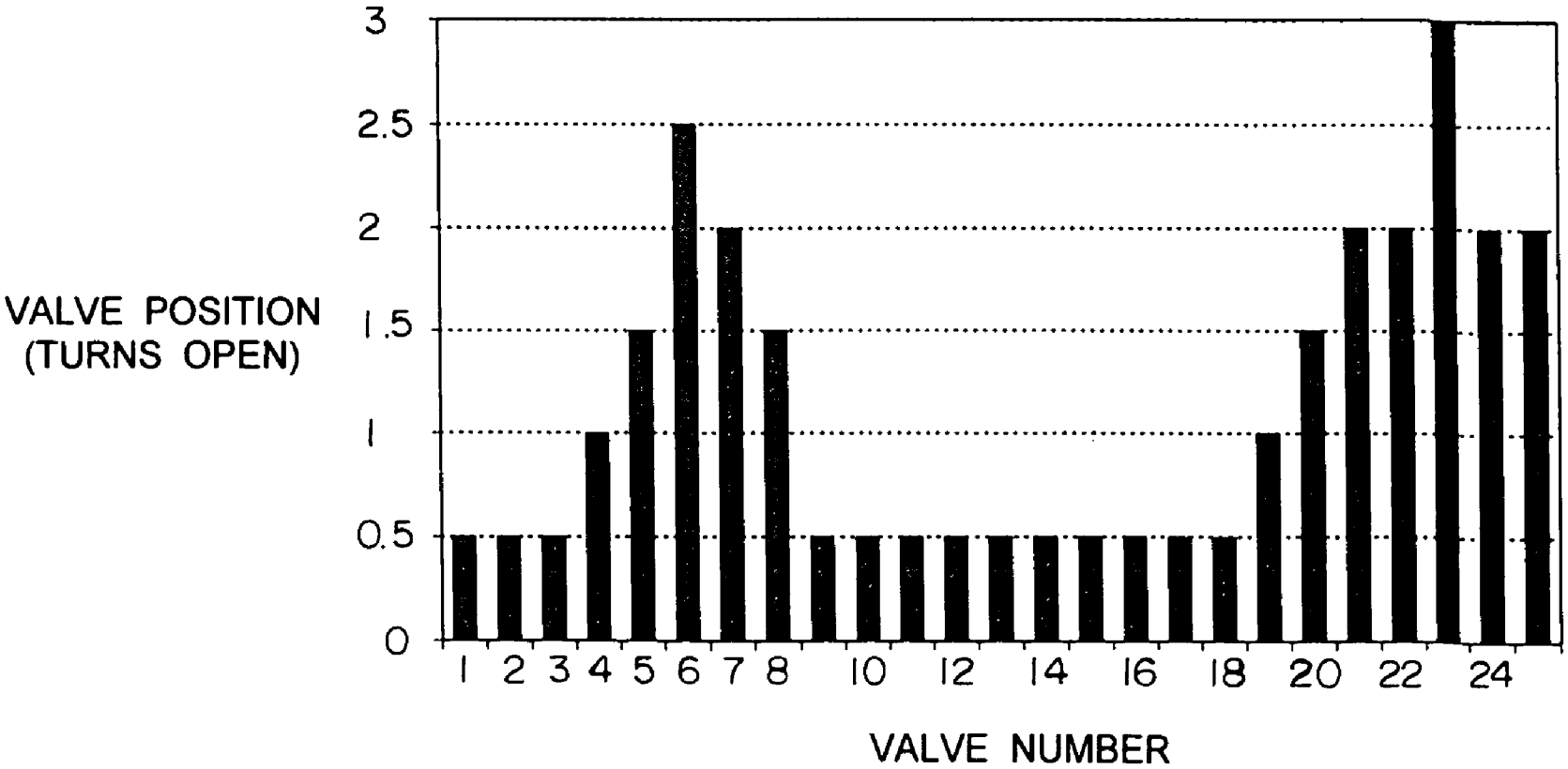
FIG. 8 shows the degree of opening of the valves of the hot strip mill across the hot strip shown in FIG. 6.
Figure 9:
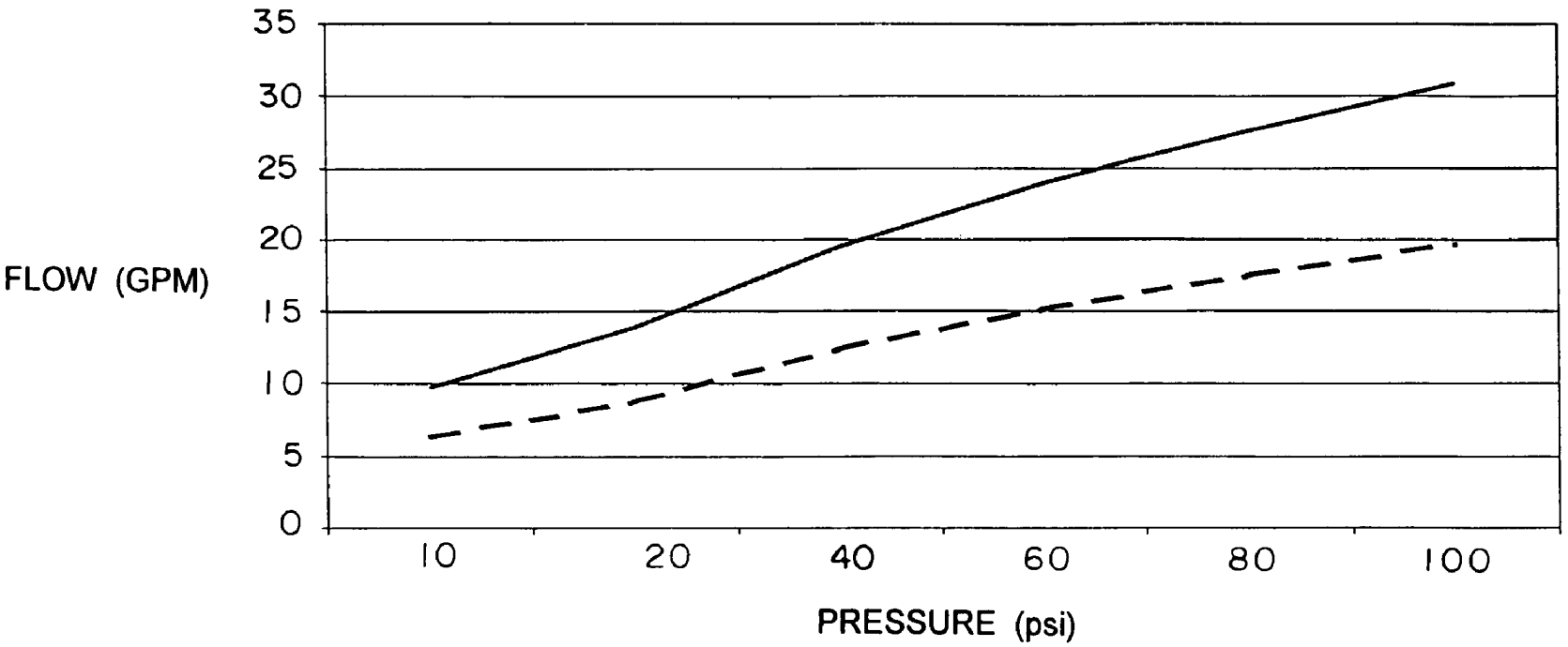
FIG. 9 is a graph showing spray nozzle flow characteristics as a function pressure of the hot strip mill across the hot strip shown in FIG. 6.

A cast sequence was hot rolled in rolling mill 15 with newly ground work profiles in work rolls 16A and 16B. Initially a small operator side quarter buckle and drive side edge wave were observed during rolling. As a result, controllable nozzles 72A and 72B adjacent both the upper and lower work rolls in this area were opened in half turn increments in an attempt to eliminate the observed defects. FIG. 8 shows the positions (in turns open) of each of the twenty five control valves 72B adjacent the lower work roll 16B; and FIG. 9 shows the coolant flow through both nozzles 71A and 71B and 72A and 72B as a function of pressure. The dotted line is for nozzles 71A and 71B and 72A and 72B in the inner and center rows of nozzles, and the solid line is for nozzles 72A and B in the outer row of nozzles. The operator drive side quarter buckle and drive side edge wave were removed as a result of the coolant flow adjustment. Upper and lower work roll temperatures were again measured at the end of rolling and the results are presented in FIG. 7.

Figure 7:
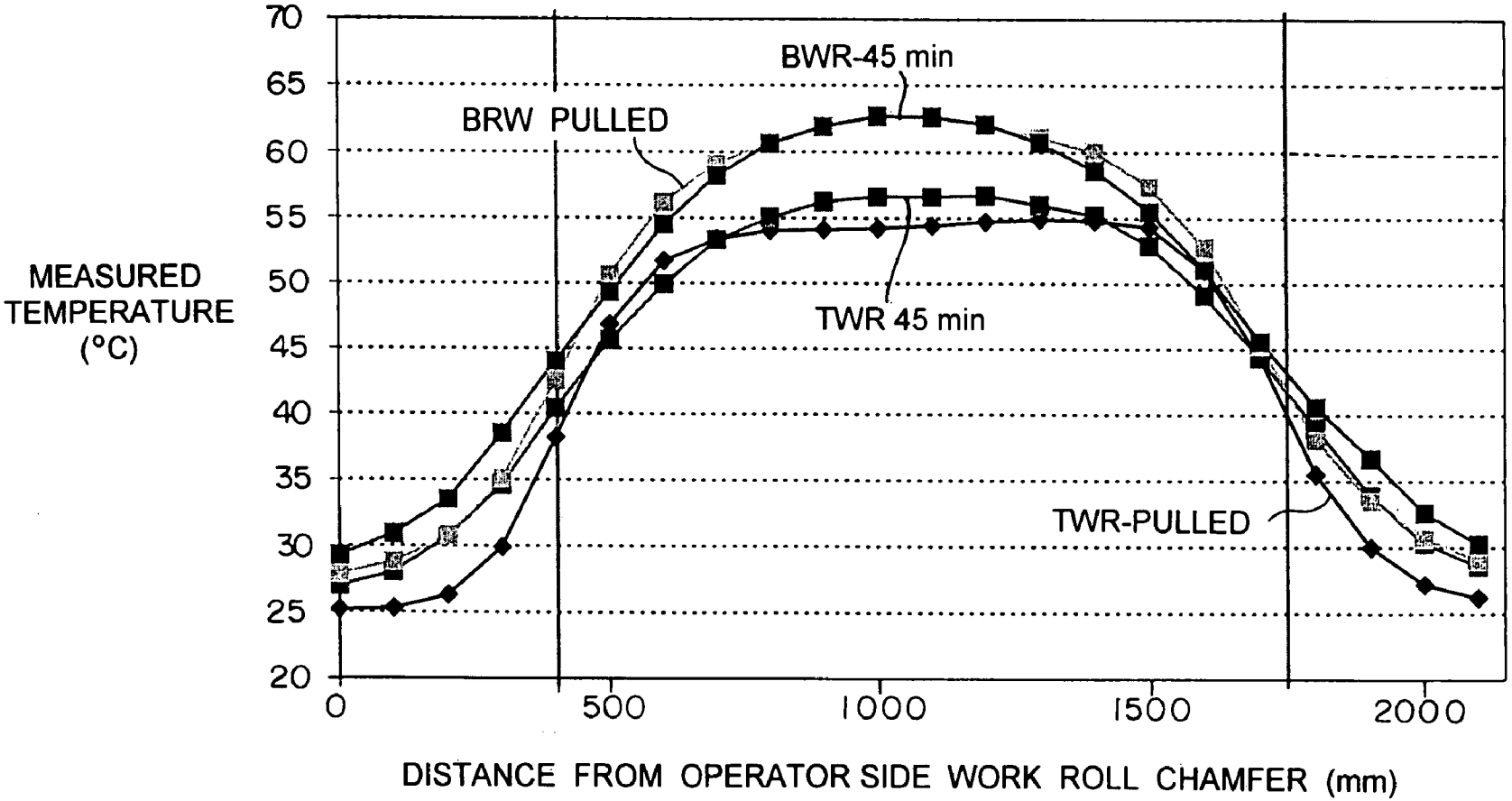
FIG. 7 is a graph showing the temperature as a function of distance across the top and bottom work rolls of a hot rolling mill in a thin strip casting plant with controlling for shape of the strip in accordance with the present invention.

The resulting temperature profiles in FIG. 7 are significantly different to those reported in FIG. 6. Firstly, the upper work roll (TWR) temperature no longer has the drive side peak observed in FIG. 6, and the roll temperature profile was similar to that obtained for the bottom work roll temperature in FIG. 6. The bottom work roll temperature now was significantly parabolic across the strip width rather than flat. The edges of the thin cast strip 12 were located at about the second and twenty-fourth spray nozzle locations. This control valve pattern and strip temperature differences between FIGS. 6 and 7 demonstrate that control of the camber of the bottom work roll 16 and in turn the shape of the strip that can be done by the present invention.

To automatically control for shape defects in the thin cast strip, variations in the shape in the strip can be sensed by a sensor device positioned at a downstream from the hot mill to sense the strip shape in individual zones across the strip, and configured to feed electrical signals indicative of the strip shape at the positions in the individual zones to a logic device of a controlled system such as a computer (not shown). The sensor device may be for example a sensor roll 29 such a 250–400 mm diameter Planicim® reflector roll made by VAI CLECIM that senses localized tension in the strip across its width. Alternatively, the sensor device may be a laser or other optical device measuring distance such as that made by LASCON. The control system controls the flow of coolant through individual controllable nozzles 72A and 72B along the width of the work rolls 16A and 16B in response to the electrical signals from the sensor device. There may be controls corresponding to each controllable nozzle 72 positioned across the work rolls 16A and 16B; however that is not necessarily so provided. In any case, the controls are capable of controlling the flow of coolant through the nozzle spray in each zone independently such as to control the shape of the working surfaces of the work rolls 16A and 16B and in turn the shape of thin cast strip.

What is claimed is:

1. A method of producing thin cast strip with controlled strip irregularities in the shape by continuous casting comprising the steps of:

a. assembling a thin strip caster having a pair of casting rolls having a nip there between;

b. assembling a metal delivery system capable of forming a casting pool between the casting rolls above the nip with side dams adjacent the ends of the nip to confine said casting pool;

c. assembling adjacent the thin strip caster a hot rolling mill having work rolls with work surfaces forming a gap between them through which hot strip is rolled, said work rolls having work roll surfaces relating to a desired strip profile across the work rolls;

d. assembling spray nozzles positioned at intervals along the work rolls of the hot rolling mill in at least three lateral zones, a central and two edge zones, and capable of spraying coolant in each zone with the flow volume of coolant sprayed by the nozzle(s) in each zone being capable of being individually controlled;

e. assembling a control system capable of individually regulating the flow of coolant from at least some of the spray nozzles in each zone onto the work surface of each work roll being sprayed;

f. introducing molten steel between the pair of casting rolls to form a casting pool supported on casting surfaces of the casting rolls confined by said side dams;

g. counter-rotating the casting rolls to form solidified metal shells on the surfaces of the casting rolls and cast thin steel strip through the nip between the casting rolls from said solidified shells; and h. rolling the thin cast strip between the work rolls of the hot rolling mill and varying the flow of coolant to at least one of the nozzles in each zone so as to control, the shape of the work surface of at least one work roll and control strip irregularities occurring in any zone in the thin cast strip.

2. The method of producing thin cast strip with a controlled strip irregularities in the shape by continuous casting as claimed in claim 1 wherein at least five lateral zones are provided, a central, two intermediate and two edge zones.

3. The method of producing thin cast strip with a controlled strip irregularities in the shape by continuous casting as claimed in claim 1 wherein there is the same number of zones as spray nozzles.

4. The method of producing thin cast strip with a controlled strip irregularities in the shape by continuous casting as claimed in claim 1 wherein the flow of coolant from each nozzle is individually controlled.

5. The method of producing thin cast strip with a controlled strip irregularities in the shape by continuous casting as claimed in claim 1 comprising the additional steps of:

i. downstream of the hot rolling mill sensing the shape of the strip in each zone;

j. automatically varying the flow of coolant to at least one of the nozzles in each zone through a control system controlled by the strip shape sensed in the strip in each zone downstream of the hot rolling mill.

6. The method of producing thin cast strip with a controlled strip irregularities in the shape by continuous casting as claimed in claim 1 wherein the spray nozzles are positioned along the work surface of both work rolls beyond the edges of the strip.

7. The method of producing thin cast strip with a controlled strip irregularities in the shape by continuous casting as claimed in claim 6 wherein at least five lateral zones are provided, a central, two intermediate and two edge zones.

8. The method of producing thin cast strip with a controlled strip irregularities in the shape by continuous casting as claimed claim 6 wherein there is the same number of zones as spray nozzles.

9. The method of producing thin cast strip with a controlled strip irregularities in the shape by continuous casting as claimed claim 6 wherein the foxy of coolant from each nozzle is individually controlled.

10. The method of producing thin cast strip with a controlled strip irregularities in the shape by continuous casting as claimed claim 6 comprising the additional steps of:

i. sensing downstream of the hot rolling mill the shape of the strip in each zone;

j. automatically varying the flow of coolant to at least one of the nozzles in each zone through a control system controlled by the strip shape sensed in the strip in each zone downstream of the hot rolling mill.

11. A thin cast strip plant for producing strip with a controlled strip irregularities in the shape by continuous casting comprising:

a. a thin strip caster having a pair of casting rolls having a nip there between;

b. a metal delivery system capable of forming a casting pool between the cast rolls above the nip with side dams adjacent the ends of the nip to confine said casting pool;

c. a hot rolling mill adjacent the thin strip caster having work rolls with work surfaces forming a gap between them through which hot strip is rolled, said work rolls having work roll surfaces relating to a desired strip profile to be rolled;

d. a plurality of localized cooling devices positioned at intervals along the work surfaces of at least one work roll of the hot rolling mill in at least three lateral zones, a central and tow edge zones, and capable of localized control of cooling of the work surface of at least one of the work rolls, with the cooling in each zone being capable of being individually controlled;

e. a drive capable of counter-rotating the casting rolls to form solidified metal shells on the surfaces of the casting rolls and cast thin steel strip through the nip between the casting rolls from said solidified shells; and f. a control system capable of individually regulating localized control of cooling of the work surface of at least one work roll of the hot rolling mill being cooled so as to control the shape of the work surface of the work roll and control irregularities occurring in the strip in any zone.

12. The thin cast strip plant for producing strip with a controlled strip irregularities in the shape by continuous casting as claimed in claim 11 wherein at least five lateral zones are provided, a central, two intermediate and two edge zones.

13. The thin cast strip plant for producing strip with a controlled strip irregularities by continuous casting as claimed claim 11 wherein there is the same number of zones as localized cooling devices.

14. The thin cast strip plant for producing strip with a controlled strip irregularities in the shape by continuous casting as claimed in claim 11 wherein each localized cooling device is individually controlled.

15. The thin east strip plant for producing strip with a controlled strip irregularities in the shape by continuous casting as claimed in claim 11 comprising in addition:

g. sensors positioned downstream of the hot rolling mill capable of sensing the shape of the strip in each zone across the strip;

h. a control system capable of automatically varying the flow of coolant to at least one of the nozzles in each zone in response to the strip shape sensed in the strip in each zone downstream of the hot rolling mill.

16. The thin cast strip plant for producing strip with a controlled strip irregularities in the shape by continuous casting as claimed in claim 15 wherein the localized cooling devices are assembled along the work surface beyond the edges of the strip.

17. The thin cast strip plant for producing strip with a controlled strip irregularities in the shape by continuous casting as claimed in claim 15 wherein at least five zones are provided, a central, two immediate and two edge zones.

18. The thin cast strip plant for producing strip with a controlled strip irregularities by continuous casting as claimed in claim 15 wherein there is the same number of zones as localized cooling devices.

19. The thin cast strip plant for producing strip with a controlled strip irregularities in the shape by continuous casting as claimed in claim 15 comprising in addition:

i. sensors positioned downstream of the hot rolling mill capable of sensing the shape of the strip in each zone across the strip;

j. a control system capable of automatically controlling the localized cooling device(s) in each zone in response to the strip shape sensed in the strip in each zone downstream of the hot rolling mill.

* * * * *